US006183591B1

(12) United States Patent
Lang

(10) Patent No.: US 6,183,591 B1
(45) **Date of Patent: *Feb. 6, 2001**

(54) APPARATUS FOR PREPARING A LATEX BALLOON NECK FOR SEALING

(75) Inventor: Philip E. Lang, London (GB)

(73) Assignee: Self Sealing Systems Limited, Warwick (GB)

( * ) Notice: Under 35 U.S.C. 154(b), the term of this patent shall be extended for 0 days.

This patent is subject to a terminal disclaimer.

(21) Appl. No.: 09/080,843

(22) Filed: May 18, 1998

Related U.S. Application Data

(62) Division of application No. 08/507,496, filed on Oct. 23, 1995, now Pat. No. 5,776,291.

(30) Foreign Application Priority Data

Jan. 29, 1993 (GB) ..... 9301810

(51) Int. Cl.[7] ..... A63H 27/10
(52) U.S. Cl. ..... 156/290; 156/308.4; 446/220
(58) Field of Search ..... 156/290, 308.6, 156/390, 535, 308.4; 446/220

(56) References Cited

U.S. PATENT DOCUMENTS

| | | | | |
|---|---|---|---|---|
| 3,953,275 | * | 4/1976 | Henderson | 156/278 |
| 4,077,588 | * | 3/1978 | Hurst | 446/226 |
| 4,586,989 | * | 5/1986 | Rasmussen | 204/15 |
| 4,594,111 | * | 6/1986 | Coonan | 134/28 |
| 4,650,059 | | 3/1987 | Fries . | |
| 4,693,695 | * | 9/1987 | Cheng | 446/220 |
| 4,765,270 | * | 8/1988 | Faber | 118/102 |
| 4,780,157 | * | 10/1988 | Coon | 156/443 |
| 5,061,145 | | 10/1991 | Genis et al. . | |
| 5,124,187 | * | 6/1992 | Aeschbacher | 428/195 |
| 5,776,291 | * | 7/1998 | Lang | 156/290 |

FOREIGN PATENT DOCUMENTS

| | | | | |
|---|---|---|---|---|
| 42 43 690 | | 3/1994 | (DE) . | |
| 42 43 691 | | 6/1994 | (DE) . | |
| 0 465 666 | | 1/1992 | (EP) . | |
| 2200299 | * | 8/1988 | (GB) . | |
| 90/00430 | * | 1/1990 | (WO) | 446/220 |

* cited by examiner

*Primary Examiner*—Sam Chuan Yao
(74) *Attorney, Agent, or Firm*—Harter, Secrest & Emery LLP; Stephen B. Salai, Esq.; Brian B. Shaw, Esq.

(57) ABSTRACT

Apparatus for preparing a latex balloon neck for sealing includes a cleaner and a refresher for cleaning and refreshing the surface of latex material at a region of the inner surface of the neck of a balloon and extending substantially around an inner circumference of the neck so that the neck can be sealed by bring opposed areas of the refreshed surface into direct contact with each other to form a latex—latex bond.

13 Claims, 7 Drawing Sheets

110
108
112
128
126
129
104
120
114
132
136
134
140
138

APPARATUS FOR PREPARING A LATEX BALLOON NECK FOR SEALING

This application is a division of application Ser. No. 08/507,496, filed on Oct. 23, 1995, now U.S. Pat. No. 5,776,291.

FIELD OF THE INVENTION

This invention relates to sealing balloon necks. In particular, it relates to a sealable balloon neck of latex, to a method and an apparatus for preparing such a balloon neck, and to a method and apparatus for preparing inflated balloons for release.

BACKGROUND OF THE INVENTION

I refer to my published applications No. GB 2200299 and WO90/00430 which relate to techniques for sealing a balloon neck, and which also describe other conventional techniques to seal necks.

A problem with conventional techniques is that they usually involve additional parts being supplied with the balloon. For example, an adhesive-sealable balloon may include a plastics tube inserted into the open neck to enable the balloon to be inflated without interfering with the adhesive. A valve-sealable balloon necessarily includes a one-way valve fitted into the balloon neck. Such additional parts are undesirable because they add to the cost and complexity of manufacture. Also, in the case of valve-sealable balloons, it has been found that the valves from balloons used in large quantities at promotional or sporting events may be deposited in farmland once the balloons have deflated and decayed. The valves can easily be eaten by farm animals and cause internal injuries to the animals, or they can cause damage to farm machinery.

A further problem with valve-sealed balloons is that the valve adds significantly to the weight of the balloon, which reduces the balloons buoyancy. In the case of balloons filled with heliox, it has been found that a 30 cm (12 inch) size balloon is required in order to generate sufficient lift to rise when fitted with a conventional valve. Such a size of balloon requires 35% more gas for filling than would a more economical 25 cm (10 inch) size balloon, which is normally unable to rise when fitted with a valve.

Additionally, conventional techniques do not permit efficient automatic inflating and releasing of balloons on a large scale at a remote release site. Often, when a large balloon release is planned at, for example, an outdoor event, a hundred or more people will be required to inflate and seal the balloons manually. Such techniques are very time consuming and labour intensive, and this adds significantly to the cost of the balloon release.

The present invention has been devised with the above drawbacks in mind.

SUMMARY OF THE INVENTION

In a first aspect, the invention provides a balloon neck of latex, wherein at least a region of the inner surface of the neck comprises a refreshed latex surface, the refreshed region extending substantially around an inner circumference of the neck, such that the neck can be sealed by bringing opposed areas of the refreshed surface into direct contact with each other to form a latex—latex bond.

The term "refreshed latex surface" is intended to include latex material whose surface is substantially clean of contaminants such as dust, dirt and, in particular, chalk and/or silicon which is often used with balloons. I have found that when two such refreshed latex surfaces are pressed into contact with each other, a direct bond is formed without the need for any additional adhesive coating. The bond may be in the form of a cold weld. The latex does not, however, seem to be susceptible to forming a bond with other types of material.

With such an arrangement, it is no longer necessary to provide additional parts to seal the balloon neck, or to assist in inflating the balloon neck prior to forming the seal.

When bringing the opposed areas of the neck into contact with each other, the neck is preferably squeezed, pinched and/or stretched such that the refreshed areas are pressed directly against each other.

It will be appreciated that in some cases, an end portion of the neck including the refreshed region may be temporarily everted so that the inner surface of the end portion faces outwardly. However, it will be understood that when the balloon is to be sealed, the everted portion of the neck would be reverted, so that the refreshed surface would be facing inwardly.

Preferably, the refreshed region includes a substantially annular region on the inner surface of the neck.

Optionally, a removable layer of protective material may be placed over the refreshed region to prevent the refreshed surface from loosing its bonding quality, for example, by becoming contaminated with dust. The protective material may, for example, comprise a tape of non-latex material, such as an adhesive tape with a metal foil backing. However, it has been found that a refreshed latex surface remain can retain its "active" bonding quality even if it is not protected by such a protective layer.

Preferably, the protective layer, if fitted, includes a pull-tab to enable the protective layer to be removed quickly and easily.

In a second aspect, the invention provides a method of preparing a latex balloon neck for sealing, the method comprising refreshing the latex material at a region of the inner surface of the balloon neck, which region extends substantially around an inner circumference of the neck, such that the neck can be sealed by bringing opposed areas of the refreshed surface into direct contact with each other to form a latex—latex bond.

Preferably, the step of refreshing the latex material comprises cleaning the surface of the material. The cleaning may comprise a step of abrasion and/or it may comprise applying a cleaning fluid to the region to be refreshed. For example, such a cleaning fluid may comprise a solvent, such as an alcohol. Preferably, the cleaning fluid is chosen such that it does not degrade the latex material.

A particularly suitable solvent is isopropanol, but other cleaning fluids could be used. It has been found that water can be used as the cleaning fluid, although this might not achieve a very durable latex—latex bond. Isopropanol is believed to be particularly advantageous as it does not tend to degrade the latex material, as might certain other solvents.

Preferably, in the case of a cleaning fluid being used, the method further comprises a step of drying the refreshed surface. If an alcohol is used as the cleaning fluid, the step of drying may comprise allowing the surface to dry under ambient conditions. The drying might, for example, be performed by ambient or heated aspiration. At normal room temperature, the neck would only take a matter of seconds or minutes to dry sufficiently. Alternatively, the drying may be formed by wiping the surface with a dry wiper.

Optionally, the method may further comprise a step of applying a protective layer of material over the refreshed surface.

Preferably, the steps of refreshing the surface, and of applying the protective layer, are performed with the end portion of the neck everted on a mandrel. This provides easy access to the "inner" surface of the neck, which might otherwise be difficult with the neck in a non-everted condition. A suitable method and apparatus for everting the neck are described in my published application No. WO90/00430. Alternatively, an "insert" method may be used for accessing the interior of the neck without everting the neck.

In a preferred form, the invention provides a method for preparing a plurality of latex balloons for sealing, the method comprising sorting a supply of latex balloons into individual sorted balloons, refreshing the latex material of each balloon at a region of the inner surface of the balloon neck, which region extends around one or more inner circumferences of the neck, such that the neck can be sealed by bringing opposed areas of the refreshed latex surface into direct contact with each other to form a latex—latex bond.

Preferably, the step of sorting the balloons comprises orientating the balloons such that each balloon is orientated in a predetermined direction.

Preferably, the method comprises everting the necks of the balloons to provide access to the inner surface of the neck.

In a third aspect, the invention, provides an apparatus for preparing a latex balloon neck for sealing, the apparatus comprising means for refreshing the surface of the latex material at a region of the inner surface of the neck, the region extending substantially around an inner circumference of the neck, such that the neck can be sealed by bringing opposed areas of the refreshed surface into direct contact with each other to form a latex—latex bond.

The means for refreshing the inner surface of the neck preferably comprises means for cleaning the surface. Such cleaning means may comprise means for cleaning by abrasion and/or means for applying a cleaning fluid.

The apparatus may comprise a mandrel on which the end portion of the balloon neck is everted such that the inner surface of the neck will face outwardly. This enables easily access to refresh the surface of the latex material. Preferably, one or both of the mandrel and the refreshing means is or are rotatable relative to the other. Alternatively, the apparatus may comprise means for expanding the neck opening to permit access to the interior surface without everting the neck.

The apparatus may also comprise means for applying a protective layer of material over the refreshed surface. The protective layer is most conveniently applied when the balloon neck is in its everted condition.

In a preferred form, the invention provides apparatus for preparing a plurality of latex balloons for sealing, the apparatus comprising means for sorting a supply of latex balloons into individual sorted balloons, means for refreshing the latex material of each balloon at a region of the inner surface of the balloon neck, which region extends around one or more inner circumferences of the neck, such that the neck can be sealed by bringing opposed areas of the refreshed surface into direct contact with each other to form a latex—latex bond.

Preferably, the means for sorting the balloons comprises means for orientating the balloons such that each balloon is orientated in a predetermined direction.

Preferably, the apparatus comprises a mandrel on which the end of the balloon neck is everted such that the inner surface of the neck will face outwardly.

Preferably, the apparatus is in the form of an automatic device or machine for performing the above operations automatically.

In a fourth aspect, the invention relates to a method of sealing a latex balloon neck, the method comprising providing a latex balloon neck which has a refreshed surface at a region of the inner surface of the neck, the refreshed region extending substantially around the inner circumference of the neck, and the method further comprising bringing opposed areas of the refreshed surface into direct contact with each other to form a seal.

The step of bringing the areas into contact with each other may comprise pressing the areas together, for example, by squeezing or pinching the neck, or by stretching the neck, or by a combination of any of these techniques.

In a preferred form, the invention provides a method for preparing and inflating balloons each having a region of the neck comprising a refreshed latex surface, the method comprising sorting a supply of such balloons into individual sorted balloons, inflating each individual balloon after sorting, and sealing each balloon after inflation by bringing opposed areas of the refreshed latex surface into direct contact with each other to form a latex—latex bond.

Preferably, the method further comprises tagging each balloon. The tagging may be performed after inflation and sealing.

Preferably, the step of sorting the balloons comprises orientating the individual balloons to achieve a predetermined orientation of each balloon.

Preferably, the method further comprises arranging the balloons for release after inflation and sealing.

In a fifth aspect, the invention also provides apparatus for preparing and inflating balloons each having a region of the neck comprising a refreshed latex surface, the apparatus comprising means for sorting a supply of such balloons into individual sorted balloons, means for inflating each individual balloon after sorting, and means for sealing each balloon after inflation by bringing opposed areas of the refreshed latex surface into direct contact with each other to form a latex—latex bond.

Preferably, the apparatus further comprises means for tagging each balloon. The tagging may be performed after inflation.

Preferably, the means for sorting the balloons comprises means for orientating the individual balloons to achieve a predetermined orientation of each balloon.

Preferably, the apparatus is in the form of automatic device or machine for performing the above operations automatically. Preferably, the apparatus is adapted to be transportable so that the unit can be transported conveniently to a desired site at which a number of balloons are to be prepared for release. For example, the apparatus may comprise a unit mounted in or on a vehicle or vehicle trailer.

It will be appreciated that the technique of refreshing the latex surface of a balloon neck to enable a latex—latex bond to be achieved offers considerable advantages in terms of the preparation of self-sealable balloons, and in terms of sealing balloons after inflation. The sealing technique lends itself to automation in an automatic inflation/sealing apparatus, which has not hithertofore been an economic proposal.

In a closely related aspect, the invention also relates to a method of inflating and sealing balloons of a type which can be sealed by bringing areas of the neck into contact with each other to form a self-adhesive bond, the method comprising sorting a supply of such balloons into individual sorted balloons, inflating each balloon after sorting, and sealing each balloon after inflation by pinching or stretching the neck to form the self adhesive bond. The method may include any of the additional features of the fourth aspect described above.

In a yet further closely related aspect, the invention relates to apparatus for inflating and sealing balloons of a type which can be sealed by bringing areas of the neck into direct contact with each other to form a self-adhesive bond, the apparatus comprising means for sorting a supply of such balloons into individual sorted balloons, means for inflating each balloon after sorting, and means for sealing each balloon after inflation by pinching or stretching the neck to form the self adhesive bond. The apparatus may include any of the additional features of the fifth aspect of the invention described above.

DESCRIPTION OF THE DRAWINGS

Embodiments of the invention are now described by way of example with reference to the accompanying drawings in which.

DESCRIPTION OF EMBODIMENTS

Figure 1:
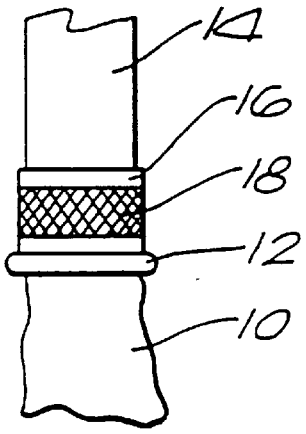
FIG. 1 shows a portion of a balloon neck everted on a mandrel for pre-treatment.

Referring to FIG. 1, a balloon neck 10 of conventional latex material is everted on a mandrel 14. A method and apparatus for performing the eversion are described in my published application No. WO90/00430. In the everted condition, the normal open end 12 of the neck 10 is pulled down the exterior surface of the balloon neck, thus exposing the surface 16 which would normally be the inner surface of the neck.

A substantially annular portion 18 of the exposed surface 16 is treated in order to refresh the surface of the latex material. After such treatment, the refreshed surface of the region 18 is able to form a latex—latex bond without requiring any additional coating of adhesive. In this exemplary embodiment, the treatment is performed by applying isopropanol to the region 18. The neck is then allowed to dry. At normal room temperature, this takes about 1 minute or less.

If desired, a layer of protective tape 20 (not shown in FIG. 1) can then be placed over the refreshed region 18 in order to prevent the refreshed latex surface from losing its bonding quality. In this exemplary embodiment, the tape is an adhesive tape with a metal foil backing.

Figure 2:
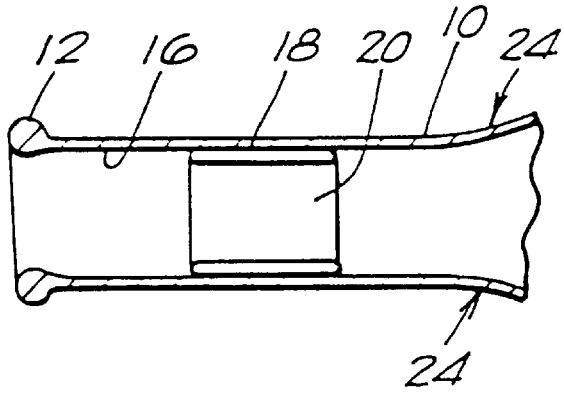
FIG. 2 is a transverse section through a portion of the balloon neck after the pre-treatment.
Figure 3:
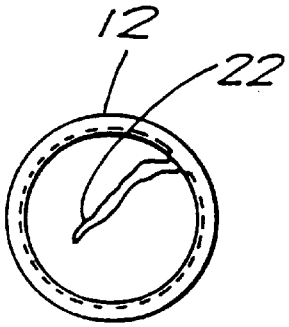
FIG. 3 is an end view looking into the open end of the balloon neck of FIG. 2.

Referring to FIGS. 2 and 3, the ends of the tape are adhered together face to face to form a pull tab 22 which is about 2–3 centimetres long. The pull tab 22 is of sufficient length to enable a person to grip the tab to remove the protective tape 20 from within the neck 10 when the neck 10 is reverted (as in FIGS. 2 and 3). In FIG. 2, the refreshed region 18 of the inner surface 16 is denoted by a thickened line, although it will be appreciated that the thickness of the material will not be increased in practice.

To inflate a balloon, a person simply blows into the open end 12 in the usual way. It will be appreciated that it is not necessary to use a separate tube in order to inflate the balloon. Once the balloon has been inflated sufficiently, a person then pinches the neck at a point which is between the body of the balloon and the refreshed surface 18 (as denoted by the arrows 24). This serves to prevent gas from escaping from the balloon while the self-sealing feature of the balloon neck is being prepared.

Figure 4:
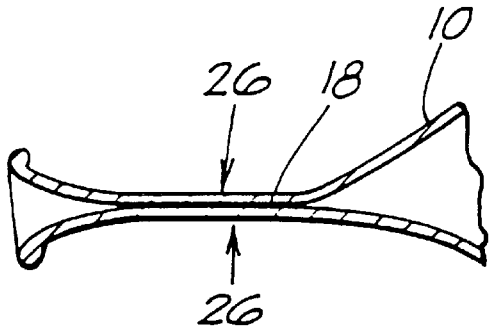
FIG. 4 is a transverse section illustrating how the balloon neck is sealed after inflation.

As a next step, the person pulls on the pull tab 22 to remove the protective tape 20 (if fitted) from within the balloon neck. The person then pinches and/or stretches the balloon at a point corresponding to the refreshed surface 18 (as denoted by the arrows 26), to bring opposed areas of the refreshed surface into direct contact with each other. Typically, the person will have to apply pressure in this way for about 2–5 seconds in order to ensure that a reliable latex—latex bond is achieved as shown in FIG. 4.

It has been found that a bond formed in this way is perfectly adequate to seal the balloon to prevent the escape of gas through the neck. It will be appreciated that such a method does not require the addition of a gas valve, or of an adhesive coating to form the seal.

Figure 5:
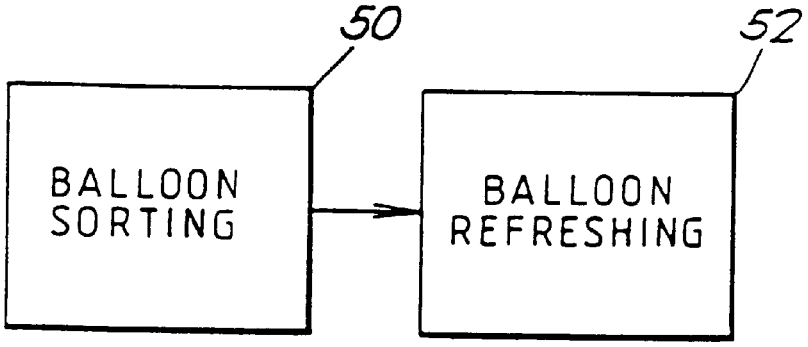
FIG. 5 is a block schematic diagram of an automatic apparatus/method for preparing balloons for sealing.

Referring to FIG. 5, an automatic method/apparatus for preparing balloons for sealing includes a first part 50 for sorting a supply of balloons into individual sorted balloons. The balloons in the original supply will be orientated in random directions, and piled on top or around each other. The sorting operation separates the balloons individually and aligns the balloons in a predetermined direction. A second part 52 operates on each individual balloon after sorting to effect the pre-treatment described above. The fitting of protective tape to the inner surface of the balloon is an optional feature of part 52.

The specific construction and operation details of the elements 50 and 52 will be easily implemented by a skilled man based on the foregoing description. However, purely by way of illustration, examples of the parts 50 and 52 are described below.

Figure 6:
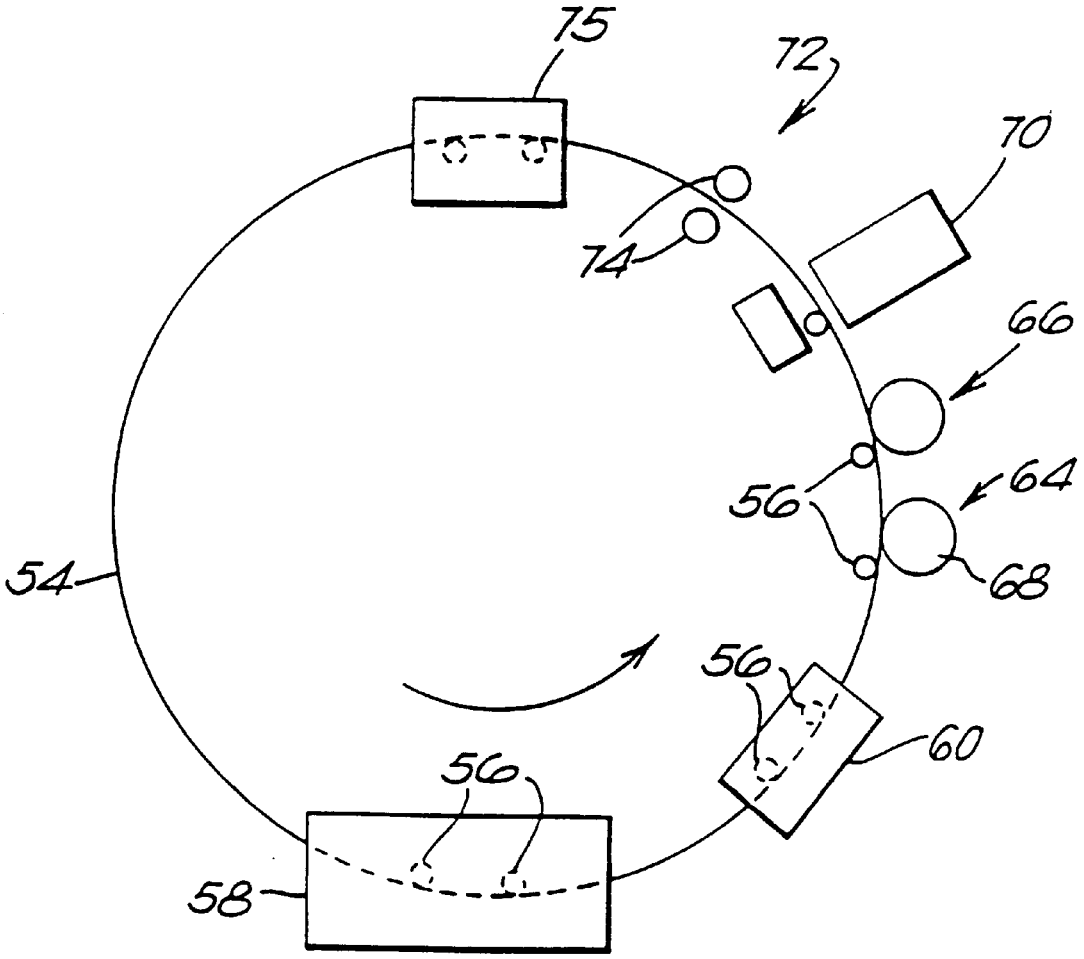
FIG. 6 is a schematic plan view illustrating an example of a work station for treating balloon necks.
Figure 7A:
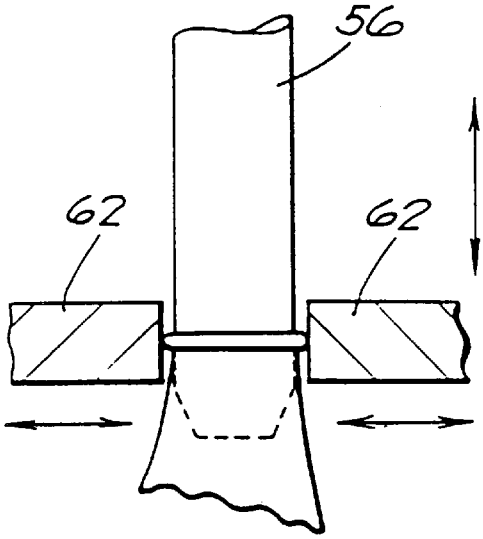
FIG. 7*a*–7*d* are schematic figures illustrating parts of the work station of FIG. 6.
Figure 7B:
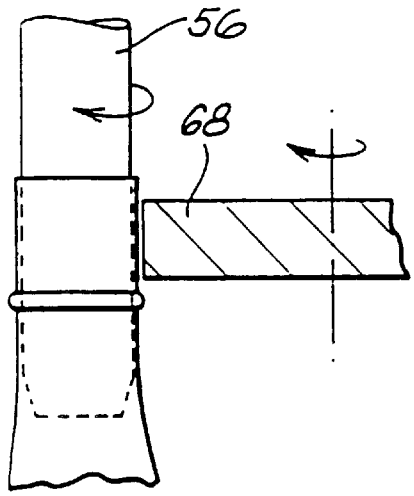
Figure 7C:
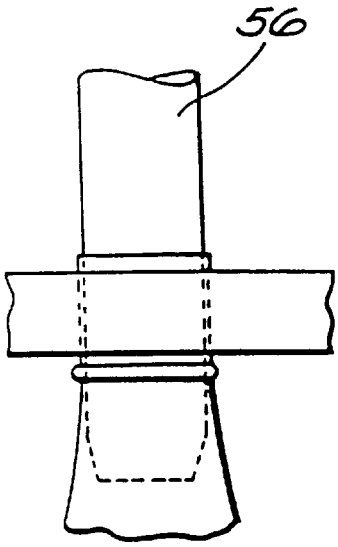
Figure 7D:
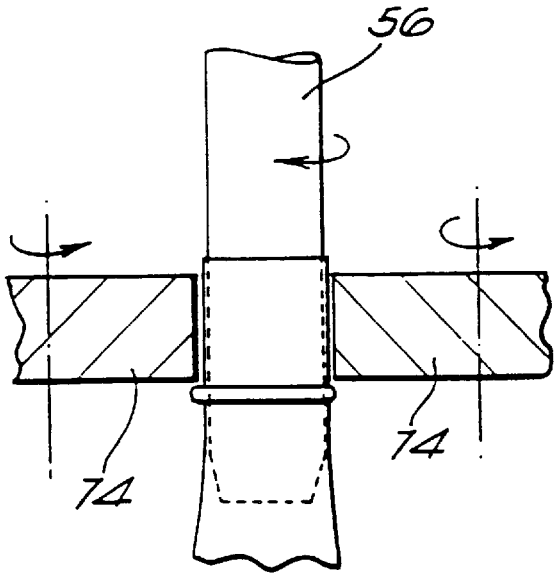

Referring to FIGS. 6 and 7, the workstation 52 may be based on a rotary support 54 which carries downwardly depending rotatable mandrels 56 (only certain of the mandrels are shown in FIG. 6; it will be appreciated that the mandrels are equally spaced around the periphery of the rotatable support). The support 54 is indexed to a supply of balloons at a supply station 58, such that the neck of a balloon is received at the end of each mandrel 56 as the support 54 rotates in a counter-clockwise direction (as viewed in FIG. 6). After passing through the supply station, the mandrels are advanced, in pairs, to an everting station 60 (FIG. 7*a*). The everting station operates as described in my International Application No. WO 90/00430 by advancing the mandrel into the neck, and then withdrawing the mandrel slightly, while pressing the balloon against the mandrel by means of pressure plates or devices 62. The everting station operates on pairs of the mandrels.

After eversion, each mandrel is advanced, in turn, through a wet-wipe station 64 (FIG. 7*b*) and a dry wipe station 66. The wet-wipe station consists of a roller pad 68 wetted with refreshing fluid, which contacts the everted balloon neck. The mandrel 56 and the roller pad 68 are rotated in the same rotational sense, such that their contacting surfaces are moving in contra-directions, thus providing an efficient cleaning action. The dry wipe section consists of a second dry roller, which rotates in the same fashion as the roller 68, in order to wipe excess fluid from the latex surface in order to accelerate drying, while at the same time performing a second cleaning "wipe". Alternatively, the dry wipe station 66 may be replaced or supplemented by a heating station (not shown) to further promote drying of the latex material.

If a protective tape is required to be fitted to the balloon necks, each mandrel 56 is then advanced to a tape applying station 70 (FIG. 7*c*) which applies a length of adhesive tape to the balloon neck, and then to a tape roller station 72 (FIG. 7*d*) which includes a pair of rollers 74 for pressing the tape securely against the latex surface, and for securing the free ends of the tape back to back to form a pull-tab.

Finally, each mandrel is advanced to a balloon removal station 75 at which each balloon is reverted back to its normal condition, and is disengaged from the mandrel 56. At removal station 75, the balloon may be removed by drawing the balloon through a pair of prongs which grasp the balloon neck, or by "blowing" or sucking the balloon from the mandrel. Optionally, balloons are transferred to a bandolier.

Figure 8:
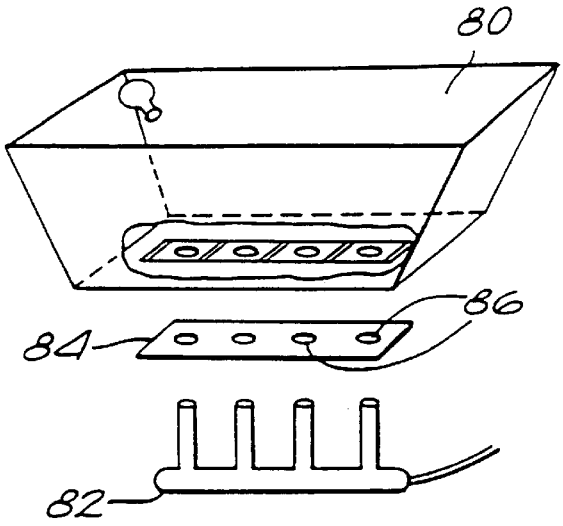
FIG. 8 is a schematic view of one example of a balloon sorter.

Referring to FIG. 8, a first example of a balloon sorter 50 includes a trough 80 into which balloons are fed. A suction device 82 is mounted below the trough 80, a movable carrier member 84 is mounted between the trough 80 and the suction device 82. Openings 86 are found in the carrier member 84 for receiving balloons. Each opening 86 is dimensioned to enable the body of a deflated, flaccid balloon to be sucked through the opening 86 by the suction device 82, but to prevent the relatively thick lip of the balloon neck from passing through. Thus the balloons will become uniformly aligned, hanging downwardly from the carrier member 84 and retained in place by their lips. The carrier member 84 is movable from its position under the trough 80 to transfer the balloons to the workstation 52.

Figure 9:
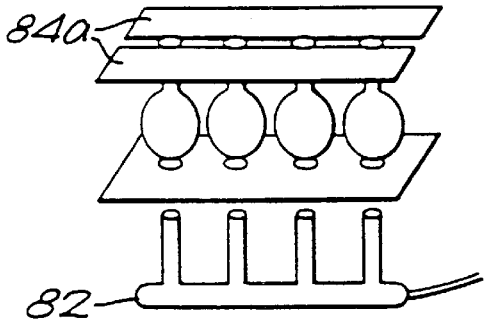
FIG. 9 is a schematic view of a slightly modified version of the sorter of FIG. 8.

FIG. 9 illustrates (in isolation) a detail of the sorter of FIG. 8 in which the balloons are carried by two closely spaced guides 84*a* which trap the lip of the balloon in the same manner as the member 84 of FIG. 8.

Figure 10:
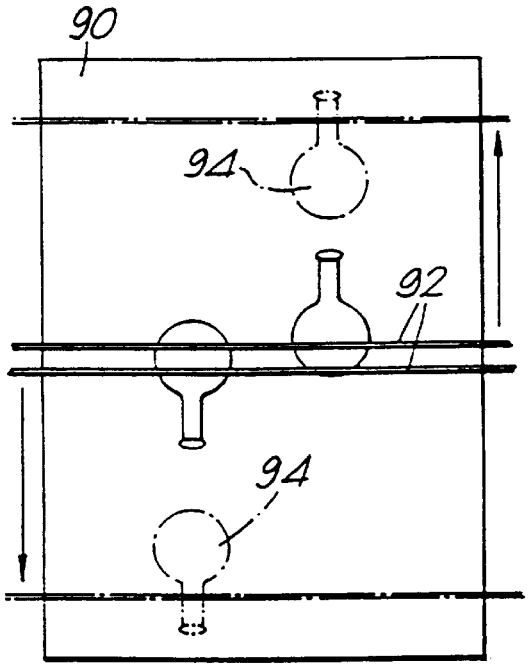
FIG. 10 is a schematic view of a second example of balloon sorter.

Referring to FIG. 10, an alternative second example of a balloon sorter 50 includes a sorting table 90 onto which balloons are dropped. A pair of sorter bars 92 descend to a level of about 3 mm (⅛ inch) above the table 90, and then move outwardly from a centre position. With this arrangement, the bars 92 engage only the projecting lips of the balloon necks, and drag the balloons by their necks towards the outer edges of the sorting table 90. As shown in phantom, the balloons 94 are thus aligned with their necks facing towards the outer edges of the table 90.

Figure 11:
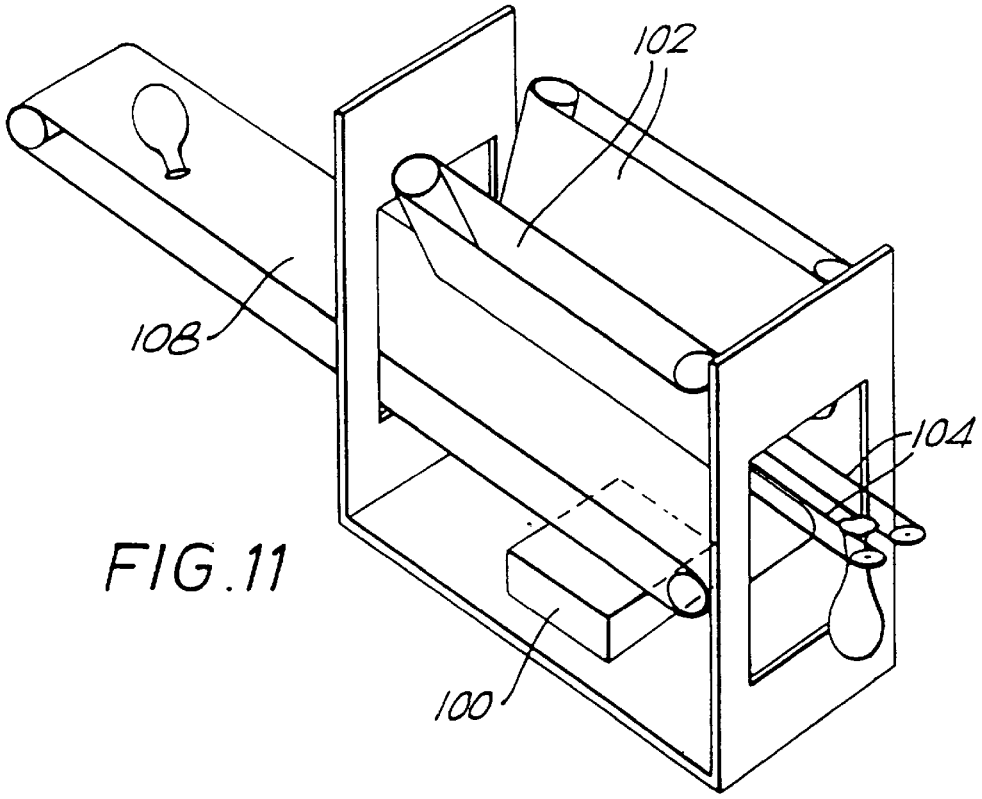
FIG. 11 is a schematic view of a third example of balloon sorter.

Referring to FIG. 11, a third example of a balloon sorter 50 is shown. The sorter includes a suction device 100 and operates on a similar principle to the sorter shown in FIG. 8. A pair of continuous guide belts 102 are mounted side by side in inclined relation to form a generally V-shaped channel into which balloons are fed. A pair of continuous carrier bands 104 are mounted side by side below the guide belts, and the suction device 100 is mounted below the carrier bands 104. The spacing between the carrier bands 104 is such that the body of a flaccid balloon can be sucked through the bands 104, but the lip of the balloon neck will be caught by the bands 104. Thus the balloons become uniformly aligned, with their bodies hanging downwardly from the carrier bands 104. Any balloons which escape completely through the space between the carrier bands 104, or which become fouled before being sucked through the carrier bands 104, are returned to the feed supply by a return conveyor belt 108. The carrier bands 104 extend beyond the run of the guide belts 102 such that balloons fouled above the carrier bands 104 are then free to drop down onto the return conveyor belt 108.

As a further alternative embodiment of a sorter, a bandolier device (not shown) may be used to sort and align the balloons.

Although only a "single channel" apparatus has been described, it will be appreciated that the apparatus may be "multi-channel" to sort and treat the balloons in several parallel channels in order to increase the productivity rate.

Although not shown specifically herein, additional apparatus may be included to count, and/or print and/or package the treated balloons.

Figure 12:
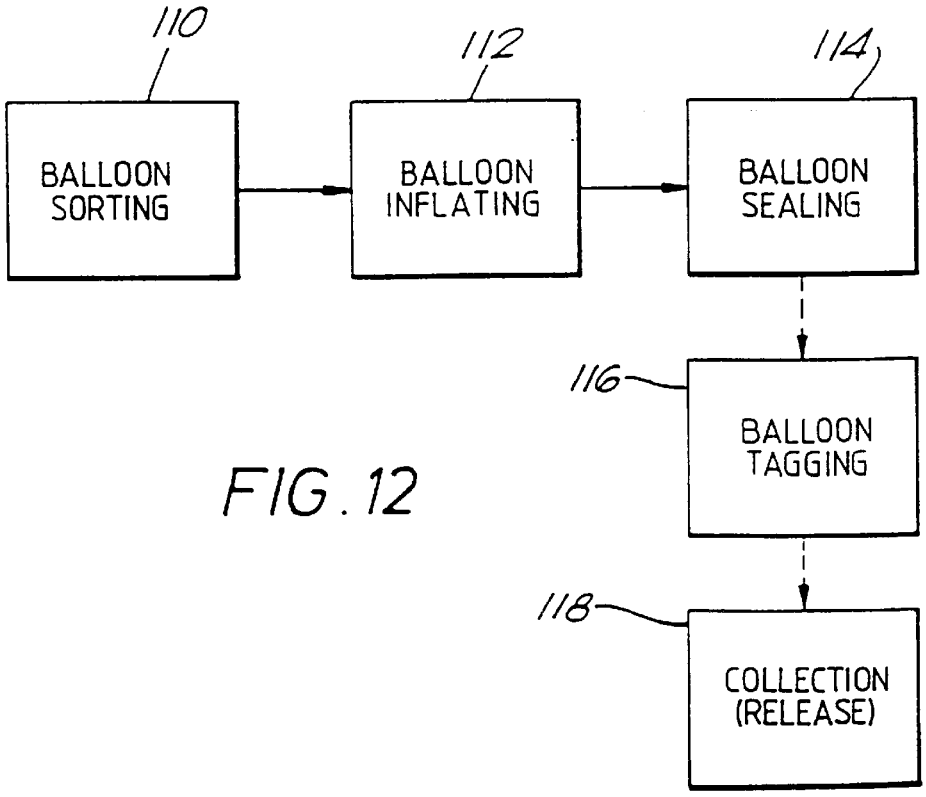
FIG. 12 is a block schematic diagram of an apparatus/method for inflating and sealing balloons automatically.

FIG. 12 illustrates schematically an automatic process/apparatus for inflating and sealing balloons of the type discussed above. Balloons from a balloon supply are firstly sorted at a first part 110 which operates in the same manner as the sorter part 50 of FIG. 5. Once sorted, the individual balloons are next inflated at part 112. The inflation can be performed using any suitable gas, such as compressed air, helium or heliox. After inflation, the balloons are sealed at part 114 by bringing together opposing areas of the refreshed surface to form a latex—latex bond. If desired, the sealed balloons can be tagged at part 116 to attach, for example, a ribbon or a streamer or an identity tag to the balloon. Finally, if desired, the balloons can be collected together by part 118 (for example, a net) and held ready for simultaneous release into the open air.

The specific construction and operation details of the parts 110–118 will be easily implemented by a skilled man based on the foregoing description. However, purely by way of illustration, an example of an automatic inflation/sealing machine is described below.

Figure 13:
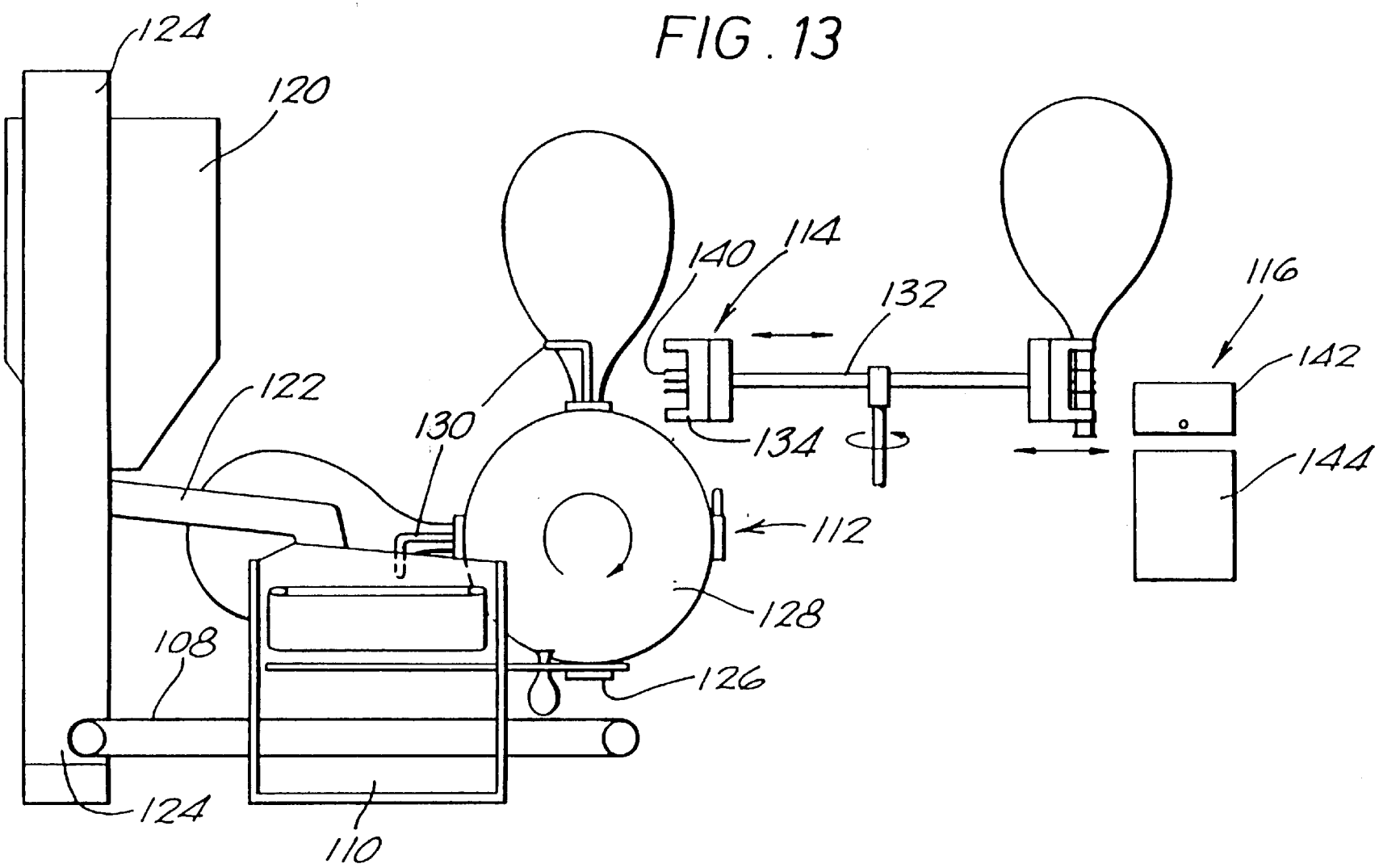
FIG. 13 is a schematic side view of a machine of FIG. 12.
Figures 14, 15:
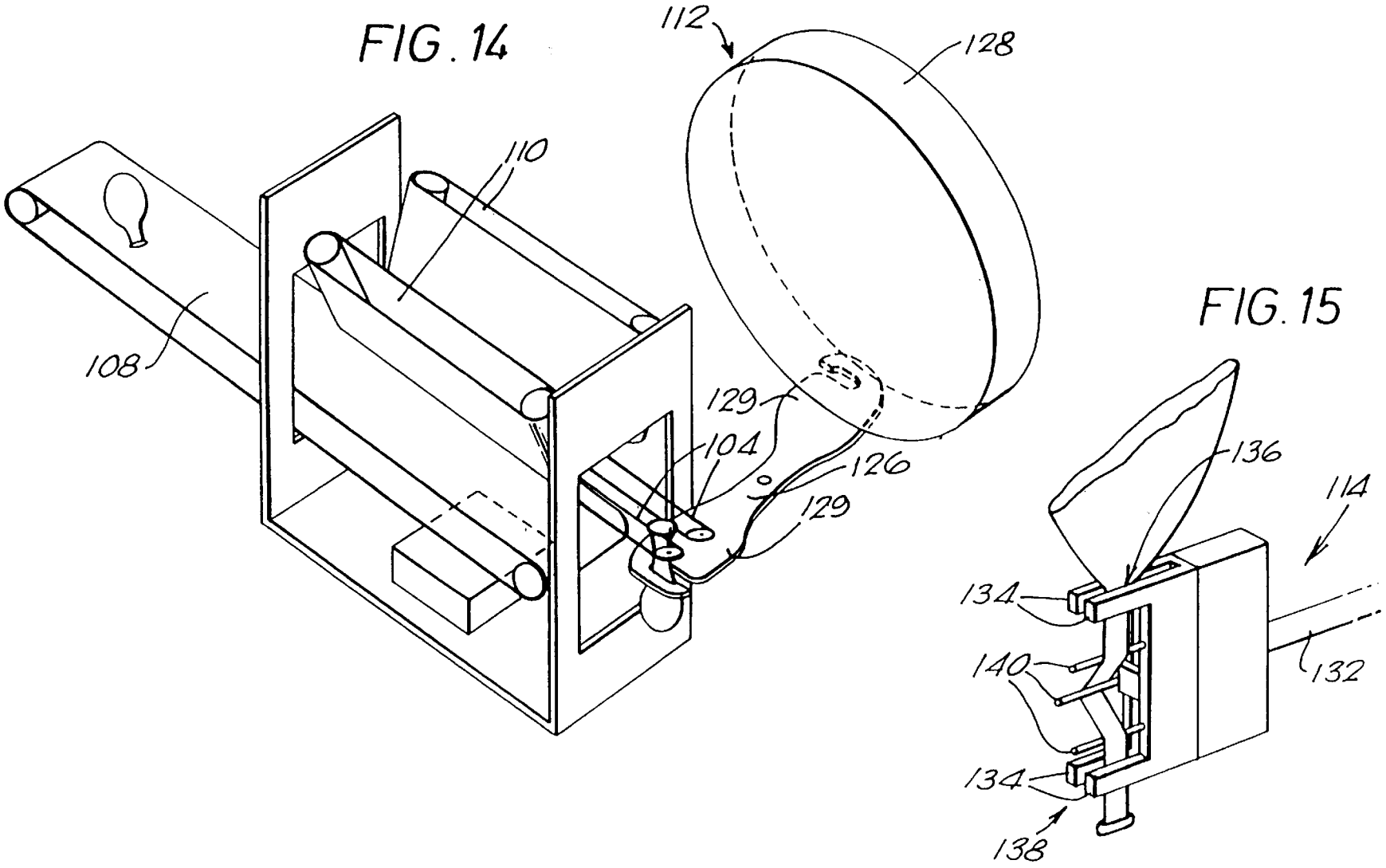
FIG. 14 is a schematic perspective view showing a detail of the machine in FIG. 13.
FIG. 15 is a schematic perspective view showing a sealing work station of the machine of FIG. 13.

Referring to FIGS. 13, 14 and 15 the machine includes a sorter 110 which, in this example, is identical to that shown in FIG. 10. However, it will be appreciated that the sorters shown in FIGS. 8 and 9 could be used instead if desired. A supply of pre-treated balloons (without protective adhesive tape) is sorted in a hopper 120 which feeds a steady supply of balloons to the sorter 110 by means of an inclined vibratory feeder 122. Reject balloons transported from the sorter 110 on the return conveyor belt 108 are returned to the hopper 120 by means of an elevator 124.

A transfer station including a rotary transfer arm 126 is used to transfer sorted balloons from the sorter 110 to the inflator part 112 in the form of a rotary inflator 128. The transfer arm 126 has hook ends 129 for "hooking" a balloon by its neck from the carrier bands 104 and swinging the balloon to the inflator 128. The transfer arm 126 is indexed by sensors for detecting the presence of a balloon on the carrier bands 104.

The inflator 128 includes a number (eg. four) of equally angularly spaced inflation nozzles with valves. An L-shaped hook arm 130 is provided at each inflation nozzle for stabilizing the balloon during inflation and for ensuring that each balloon, when inflated, has a sufficiently long neck to enable it to be grasped by the sealer 114 (described below). The transfer arm 126 is indexed to the inflator 128 such that it presents a balloon to the inflator 128 as an inflation nozzle is rotated past the transfer station. The balloons may be inflated by any suitable gas, such as heliox or compressed air. In the case of compressed air, the air may be supplied from a bottle supply or directly from an air compressor.

Once inflated, the balloon is removed from the inflator 128 by the sealer 114 which is in the form of a rotary arm 132 with jaws 134. The jaws 134 clamp the neck at points (136 and 138) above and below the refreshed area of the balloon neck to prevent gas from escaping through the neck while the neck is being sealed. The neck is sealed by being stretched over an arrangement of staggered pins 140. The stretching pulls the latex material taught such that opposing refreshed areas of the latex surface press against each other to form a latex—latex bond.

Once sealed, the balloon can be tagged by means of a tagging gun 142 at the tagging station 116. A tag feeder 144 presents tags for use by the tagging gun 142. Tags can be selected as required, for example, paper address tag, ribbons, streamers or strings. The balloon is then released by opening the jaws 134 of the sealer 114.

As a modification to the machine of FIG. 13, the sorter 110, belt 108, feeder 122, hopper 120, and the elevator 124 and the transfer arm 126 can all be replaced by a bandolier feed system.

The machine described above can be designed so as to be transportable to a site at which a balloon release is planned to take place. The machine can be left operating automatically to produce a collection of inflated and sealed balloons ready for release into the open air. Typically, it is envisaged that the or each machine would be able to produce 3600 inflated balloons per hour.

Although only a "single channel" machine has been illustrated in FIG. 13, it will be appreciated that a "multi-channel" machine may be used in which a number of balloons are inflated simultaneously in parallel work stations in order to increase productivity.

Although not shown specifically herein, additional apparatus may be included to count and/or print on the balloons.

It will also be appreciated that the foregoing is merely a description of preferred forms of the invention, and that modifications of detail may be made without departing from the scope and principles of the invention.

What is claimed is:

1. Apparatus for preparing inflating and sealing balloons, the apparatus comprising:

a mandrel supporting a latex balloon neck;

a supply of non-adhesive cleaning fluid that does not degrade latex:

an everter, cooperating with the mandrel for exposing an inside surface of the balloon neck for refreshing and for supporting a cleaned balloon neck for drying;

a refresher cooperating with the mandrel for applying the non-adhesive cleaning fluid which does not degrade latex to the exposed inside surface of the balloon neck while the balloon neck is supported by the mandrel for refreshing the surface and, after drying, leaving it suitable for sealing by bringing opposed areas of the refreshed surface together to form a latex—latex bond means for sorting a supply of such balloons into individual sorted balloons;

means for inflating each balloon after sorting and refreshing; and means for sealing each balloon after inflation by bringing opposed areas of the refreshed latex balloon surface into direct contact with each other to form a latex—latex bond.

2. Apparatus according to claim 1, further comprising means for tagging each balloon.

3. Apparatus according to claim 1, wherein the means for sorting the balloons comprises means for orientating the individual balloons to achieve a predetermined orientation of each balloon.

4. Apparatus according to claim 1, wherein the apparatus is in the form of an automatic machine.

5. Apparatus according to claim 1, wherein the apparatus is adapted to be transportable.

6. Apparatus as claimed in claim 1, wherein the means for sealing comprises means for bringing opposed areas of the refreshed surface into contact, stretching the neck and pinching the neck to form the self-adhesive, latex—latex bond.

7. Apparatus according to claim 1, in which the refresher comprises means for abrading the region of the balloon neck to be refreshed.

8. Apparatus for preparing a latex balloon neck for non-adhesive sealing comprising:

a mandrel supporting a balloon neck;

a supply of non-adhesive cleaning fluid that does not degrade latex;

an everter, cooperating with the mandrel for exposing an inside surface of the balloon neck for refreshing and for supporting a cleaned balloon neck for drying; and a refresher cooperating with the mandrel for applying the non-adhesive cleaning fluid which does not degrade latex to the exposed inside surface of the balloon neck while the balloon neck is supported by the mandrel for refreshing the surface and, after drying, leaving it suitable for sealing by bringing opposed areas of the refreshed surface together to form a latex—latex bond.

9. Apparatus according to claim 8, wherein the refresher comprises means for wiping a fluid over the surface to be refreshed.

10. Apparatus according to claim 8, in which the everter comprises means for everting an end portion of the balloon neck such that the inner surface of the neck will be presented as facing outwardly.

11. Apparatus according to claim 8, further comprising means for abrading the surface of the latex material at a region of the inner surface of the neck of said balloon.

12. Apparatus according to claim 9, wherein the means for wiping comprises a roller pad wetted with a refreshing fluid that contacts the surface to be refreshed.

13. Apparatus according to claim 12, wherein the refresher comprises a dry roller pad that wipes excess refreshing fluid from said surface.

* * * * *

UNITED STATES PATENT AND TRADEMARK OFFICE

CERTIFICATE OF CORRECTION

PATENT NO. : 6,183,591 B1
DATED : February 6, 2001
INVENTOR(S) : Philip E. Lang

It is certified that error appears in the above-identified patent and that said Letters Patent is hereby corrected as shown below:

Title page,
Item [30], Foreign Application Priority Data should read:
Jan. 29. 1993 (GB).....9301810.9

Signed and Sealed this

Second Day of October, 2001

*Attest:*

Nicholas P. Godici

*Attesting Officer*

NICHOLAS P. GODICI
*Acting Director of the United States Patent and Trademark Office*